US005642849A

United States Patent [19]

Chen

[11] Patent Number: 5,642,849

[45] Date of Patent: Jul. 1, 1997

[54] BARREL UNIT WITH A REMOVABLE COVER PLATE FOR A NAIL DRIVING GUN

[75] Inventor: Robert Chen, Taichung Hsien, Taiwan

[73] Assignee: Lih Jie Industrial Co., Ltd., Taichung, Taiwan

[21] Appl. No.: 566,246

[22] Filed: Dec. 1, 1995

[51] Int. Cl.[6] ..... B25C 1/04

[52] U.S. Cl. ..... 227/123; 227/127

[58] Field of Search ..... 227/120, 123, 227/127, 128

[56] References Cited

U.S. PATENT DOCUMENTS

| | | | |
|---|---|---|---|
| 4,139,137 | 2/1979 | Gupta | 227/123 |
| 4,436,236 | 3/1984 | Jobe | 227/123 |
| 4,467,952 | 8/1984 | Morrell, Jr. | 227/123 |
| 4,641,772 | 2/1987 | Skuthan | 227/123 |
| 4,688,710 | 8/1987 | Massari, Jr. et al. | 227/123 |

*Primary Examiner*—Scott A. Smith

*Attorney, Agent, or Firm*—Panitch Schwarze Jacobs & Nadel, P.C.

[57] ABSTRACT

A barrel unit for a nail driving gun includes an elongated base plate and an elongated cover plate. The base plate has a top side formed with a longitudinal discharge groove, a pair of upwardly extending positioning lugs at a rear portion of the base plate, and a pair of upwardly extending hooking lugs at a front portion of the base plate. Each of the positioning lugs has a rearwardly inclining rear end surface. The cover plate is formed with a pair of first slots and a pair of second slots which permit extension of a respective one of the positioning lugs and the hooking lugs therethrough. Each of the first slots has a rearwardly inclining end wall surface which abuts against the rear end surface of the respective one of the positioning lugs when the cover plate is superimposed on the base plate. The cover plate further has an operating lever which is mounted pivotally thereon, and a U-shaped fastener which has two ends connected pivotally to the operating lever and which is pivotable so as to engage the hooking lugs on the base plate when the cover plate is superimposed on the latter. The operating lever is pivotable so as to pull the fastener to engage tightly the hooking lugs.

2 Claims, 6 Drawing Sheets

BARREL UNIT WITH A REMOVABLE COVER PLATE FOR A NAIL DRIVING GUN

BACKGROUND OF THE INVENTION

1. Field of the Invention

The invention relates to a nail driving gun, more particularly to a barrel unit with a removable cover plate for a nail driving gun.

2. Description of the Related Art

In a known nail driving gun, a nail feeding unit aligns a nail from a nail cartridge with a nail impelling unit so as to discharge the nail via a barrel unit. Jamming of the nail driving gun usually occurs, thereby preventing the discharge of the nail through the barrel unit. In order to resume proper operation of the nail driving gun, a cover plate of the barrel unit is removed to remedy the cause of jamming. Thus, it is important for the barrel unit to have a structure which facilitates installation and removal of the cover plate.

Referring to FIGS. 1 and 2, a conventional barrel unit is shown to be installed on a front end of a nail driving gun 10 and includes an elongated base plate 11 which extends forwardly from the housing of the nail driving gun 10. The base plate 11 has a top side formed with a longitudinal discharge groove 110 and a pair of upwardly extending hooking lugs 12 which are disposed respectively on opposite sides of the discharge groove 110 and which are integral with the base plate 11. The cover plate 13 is to be superimposed on the base plate 11 and is formed with a pair of slots 14 which permit extension of the hooking lugs 12 therethrough. An operating lever 15 is mounted pivotally on the cover plate 13. A U-shaped fastener 16 has two ends connected pivotally to the operating lever 15. After the fastener 16 has been pivoted relative to the operating lever 15 so as to engage the hooking lugs 12, the operating lever 15 is pivoted rearwardly so as to pull the fastener 16 to engage tightly the hooking lugs 12 and so as to press the cover plate 13 against the base plate 11. When it is desired to remove the cover plate 13, the operating lever 15 is pivoted forwardly to permit removal of the fastener 16 from the hooking lugs 12 and to permit lifting of the cover plate 13 from the base plate 11.

As shown in FIG. 3, the shock experienced by the nail driving gun during a nail driving operation may cause slight movement of the cover plate 13 relative to the base plate 11 which, in turn, may loosen engagement between the fastener 16 and the hooking lugs 12. Thus, untimely removal of the cover plate 13 from the base plate 11 is likely to occur when the aforementioned conventional barrel unit is in use.

Referring to FIG. 4, another conventional barrel unit is shown to be similarly installed on a front end of a nail driving gun 20 and includes an elongated base plate 21 which extends forwardly from the housing of the nail driving gun 20. The base plate 21 has a top side formed with a longitudinal discharge groove 210 and a pair of upwardly extending hooking lugs 22 which are disposed respectively on opposite sides of the discharge groove 210 and which are integral with the base plate 21. The cover plate 23 has one end mounted pivotally on the base plate 21 by means of a pin (not shown) and is to be superimposed on the base plate 21. An operating lever 24 is mounted pivotally on the cover plate 23. A U-shaped fastener 25 has two ends connected pivotally to the operating lever 24. When the cover plate 23 is superimposed on the base plate 21, the fastener 25 can be pivoted relative to the operating lever 24 so as to engage the hooking lugs 22. At this time, the operating lever 24 can be pivoted rearwardly so as to pull the fastener 25 to engage tightly the hooking lugs 22. When it is desired to access the discharge groove 210, the operating lever 24 is pivoted forwardly to permit removal of the fastener 25 from the hooking lugs 22 and to permit pivoting movement of the cover plate 23 relative to the base plate 21 for accessing the discharge groove 210.

If the nail driving gun 20 is used to drive several nails in rapid succession, the shock experienced by the cover plate 23 during the nail driving operation may loosen the pin from the base plate 21, thereby resulting in untimely removal of the cover plate 23 from the base plate 21.

SUMMARY OF THE INVENTION

Therefore, the object of the present invention is to provide a barrel unit for a nail driving gun which can overcome the aforementioned drawbacks commonly associated with the prior art.

More specifically, the object of the present invention is to provide a barrel unit with a base plate and a cover plate that can be mounted conveniently and removably on the base plate while minimizing the risk of untimely removal from the base plate.

Accordingly, the barrel unit of the present invention is to be installed on a front end of a nail driving gun and comprises:

an elongated base plate having a top side formed with a longitudinal discharge groove, a pair of upwardly extending positioning lugs which are disposed respectively on opposite sides of the discharge groove and which are located at a rear portion of the base plate, and a pair of upwardly extending hooking lugs which are disposed respectively on opposite sides of the discharge groove and which are located at a front portion of the base plate, each of the positioning lugs having a rearwardly inclining rear end surface; and an elongated cover plate formed with a pair of first slots and a pair of second slots which permit extension of a respective one of the positioning lugs and the hooking lugs therethrough, each of the first slots having a rearwardly inclining end wall surface which abuts against the rear end surface of the respective one of the positioning lugs when the cover plate is superimposed on the base plate, the cover plate further having an operating lever which is mounted pivotally thereon, and a U-shaped fastener which has two ends connected pivotally to the operating lever and which is pivotable so as to engage the hooking lugs on the base plate when the cover plate is superimposed on the base plate, the operating lever being pivotable so as to pull the fastener to engage tightly the hooking lugs.

Preferably, the first and second slots are slightly longer than the respective one of the positioning lugs and the hooking lugs to facilitate passage of the positioning lugs and the hooking lugs through the first and second slots.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
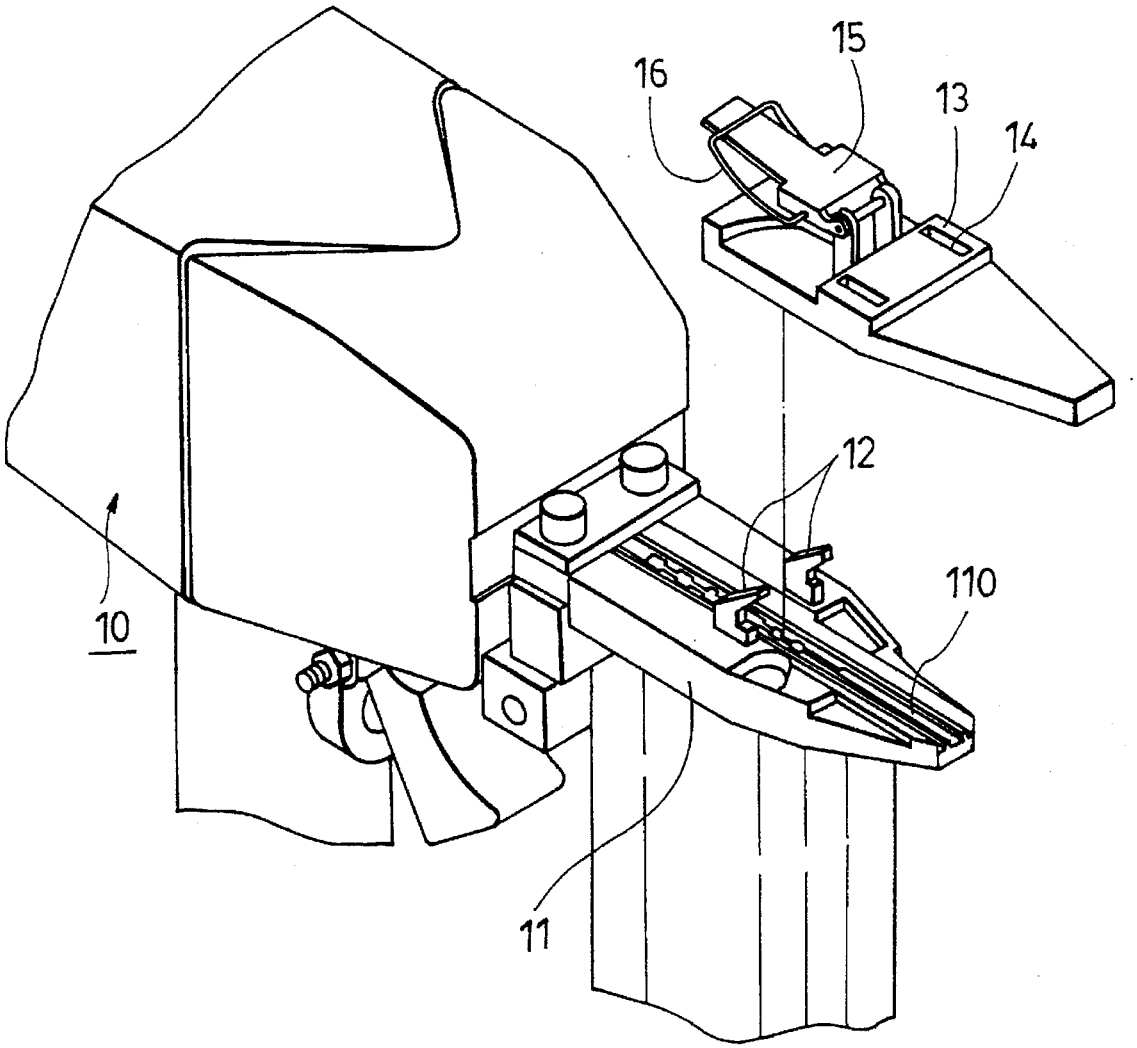
FIG.1 PRIOR ART
FIG. 1 is a perspective view illustrating a conventional barrel unit for a nail driving gun.
Figure 2:
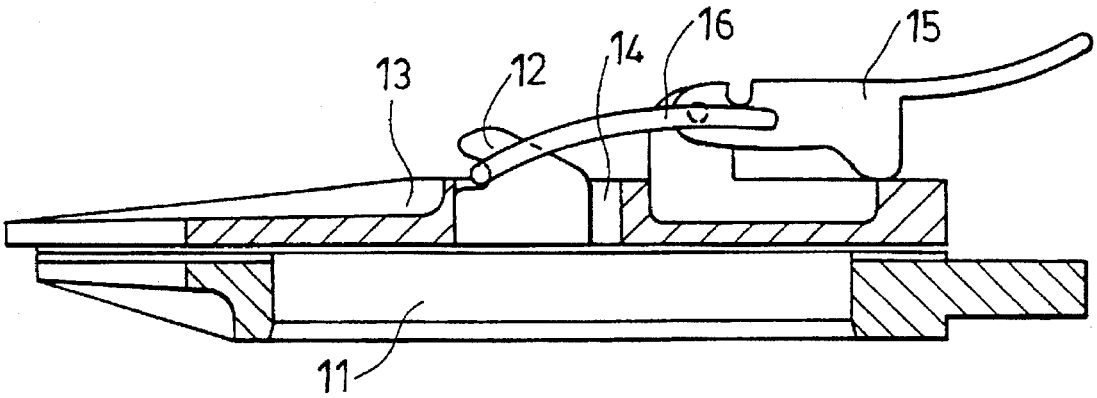
FIG.2 PRIOR ART
FIG. 2 is a schematic sectional view illustrating how the cover plate of the conventional barrel unit is secured to a base plate.
Figure 3:
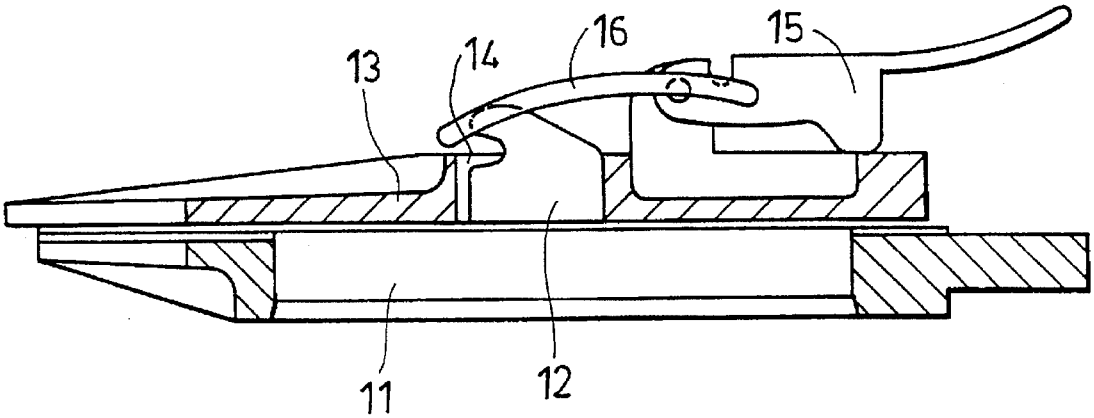
FIG.3 PRIOR ART
FIG. 3 is a schematic sectional view illustrating how untimely removal of the cover plate of the conventional barrel unit from the base plate occurs.
Figure 4:
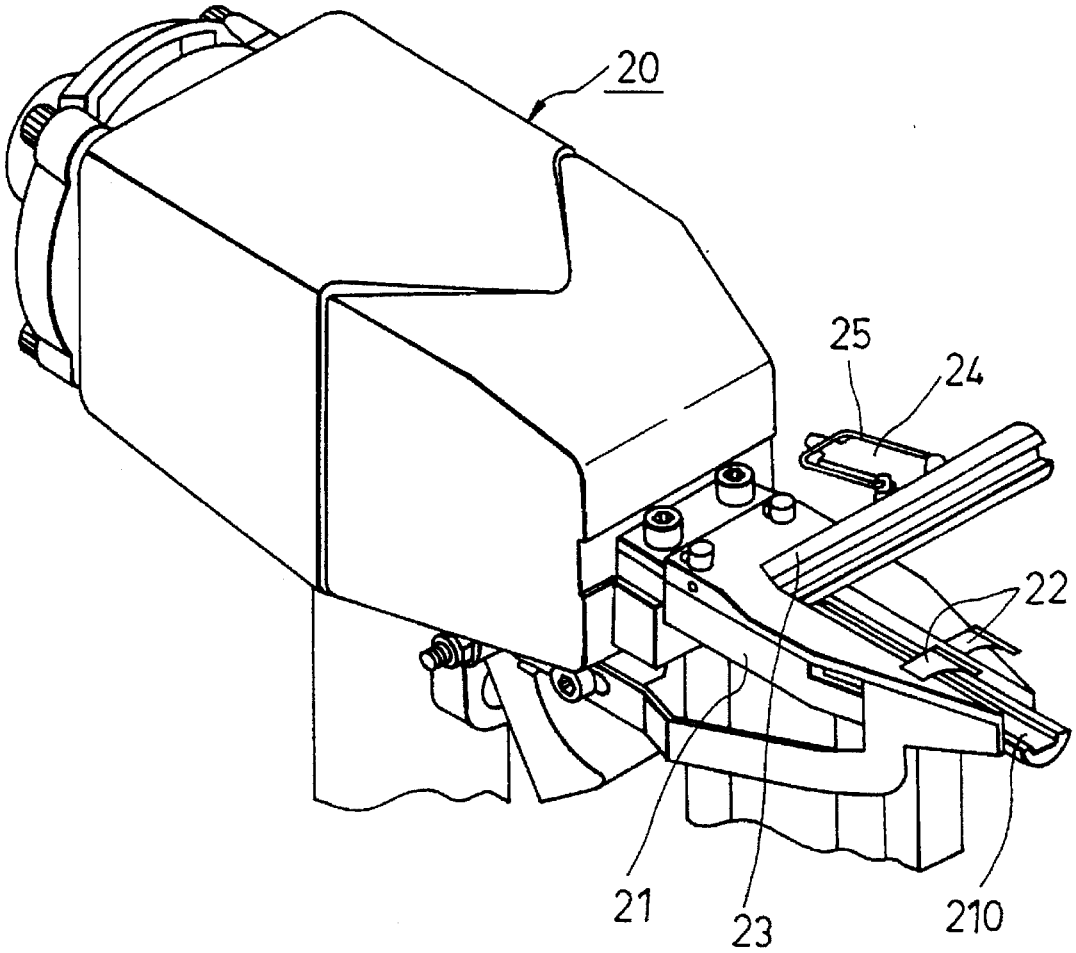
FIG.4 PRIOR ART
FIG. 4 is a perspective view illustrating another conventional barrel unit for a nail driving gun.
Figure 5:
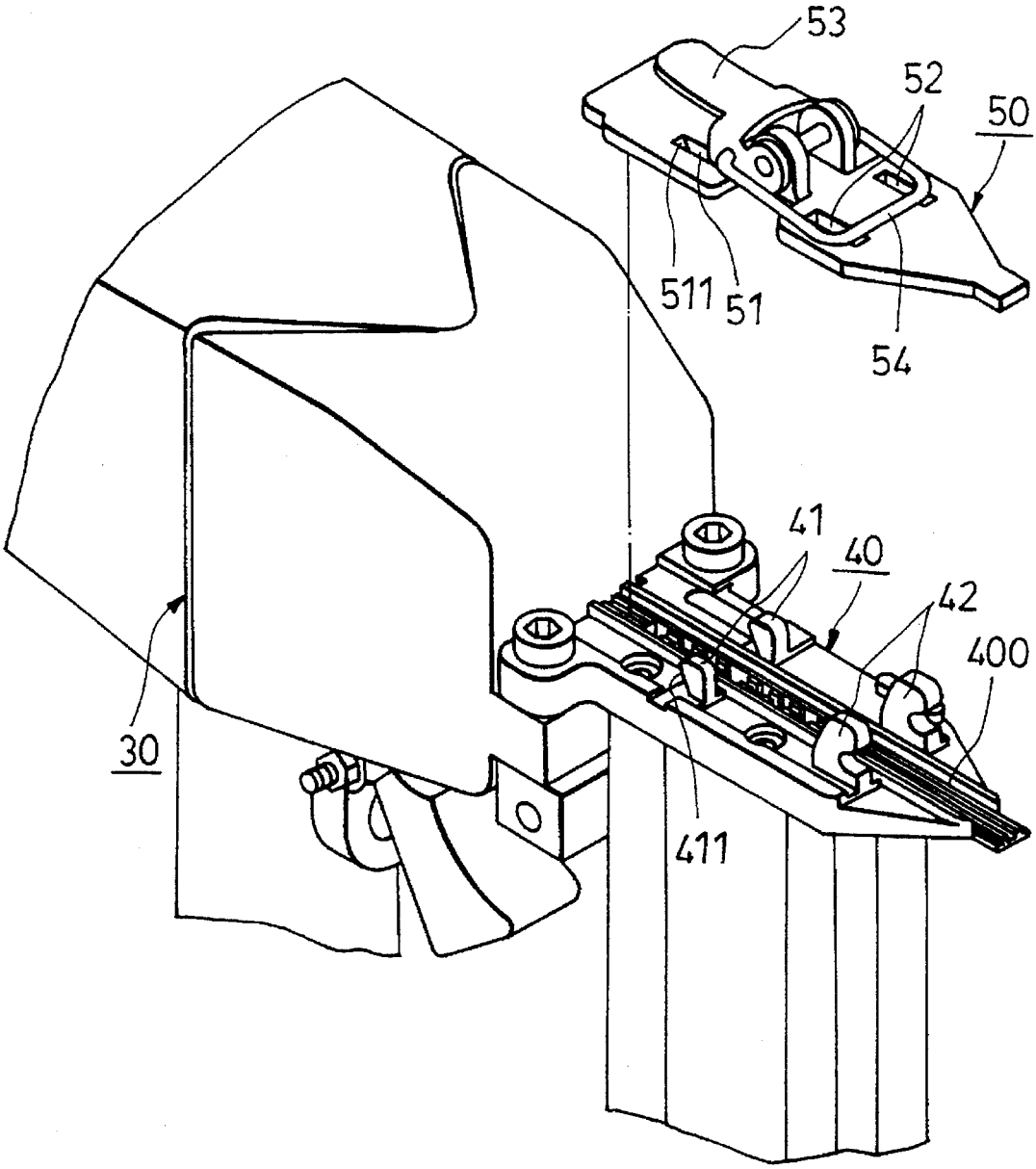
FIG. 5 is a perspective view illustrating the preferred embodiment of a barrel unit for a nail driving gun in accordance with the present invention.

Referring to FIG. 5, the preferred embodiment of a barrel unit according to the present invention is shown to be installed on a front end of a nail driving gun 30 and includes an elongated base plate 40 and an elongated cover plate 50 to be superimposed on the base plate 40.

The base plate 40 extends forwardly from the housing of the nail driving gun 10 and has a top side formed with a longitudinal discharge groove 400, a pair of upwardly extending positioning lugs 41 which are disposed respectively on opposite sides of the discharge groove 400 and which are located at a rear portion of the base plate 40, and a pair of upwardly extending hooking lugs 42 which are disposed respectively on opposite sides of the discharge groove 400 and which are located at a front portion of the base plate 40. Each of the positioning lugs 41 has a rearwardly inclining rear end surface 411.

The cover plate 50 is formed with a pair of first slots 51 and a pair of second slots 52 which permit extension of a respective one of the positioning lugs 41 and the hooking lugs 42 therethrough. Preferably, the first and second slots 51, 52 are slightly longer than the respective one of the positioning lugs 41 and the hooking lugs 42. Each of the first slots 51 has a rearwardly inclining end wall surface 511 which abuts against the rear end surface 411 of the respective one of the positioning lugs 41 when the cover plate 50 is superimposed on the base plate 40. An operating lever 53 is mounted pivotally on the cover plate 50 and is located between the first and second slots 51, 52. A U-shaped fastener 54 has two ends connected pivotally to the operating lever 53.

Figure 6:
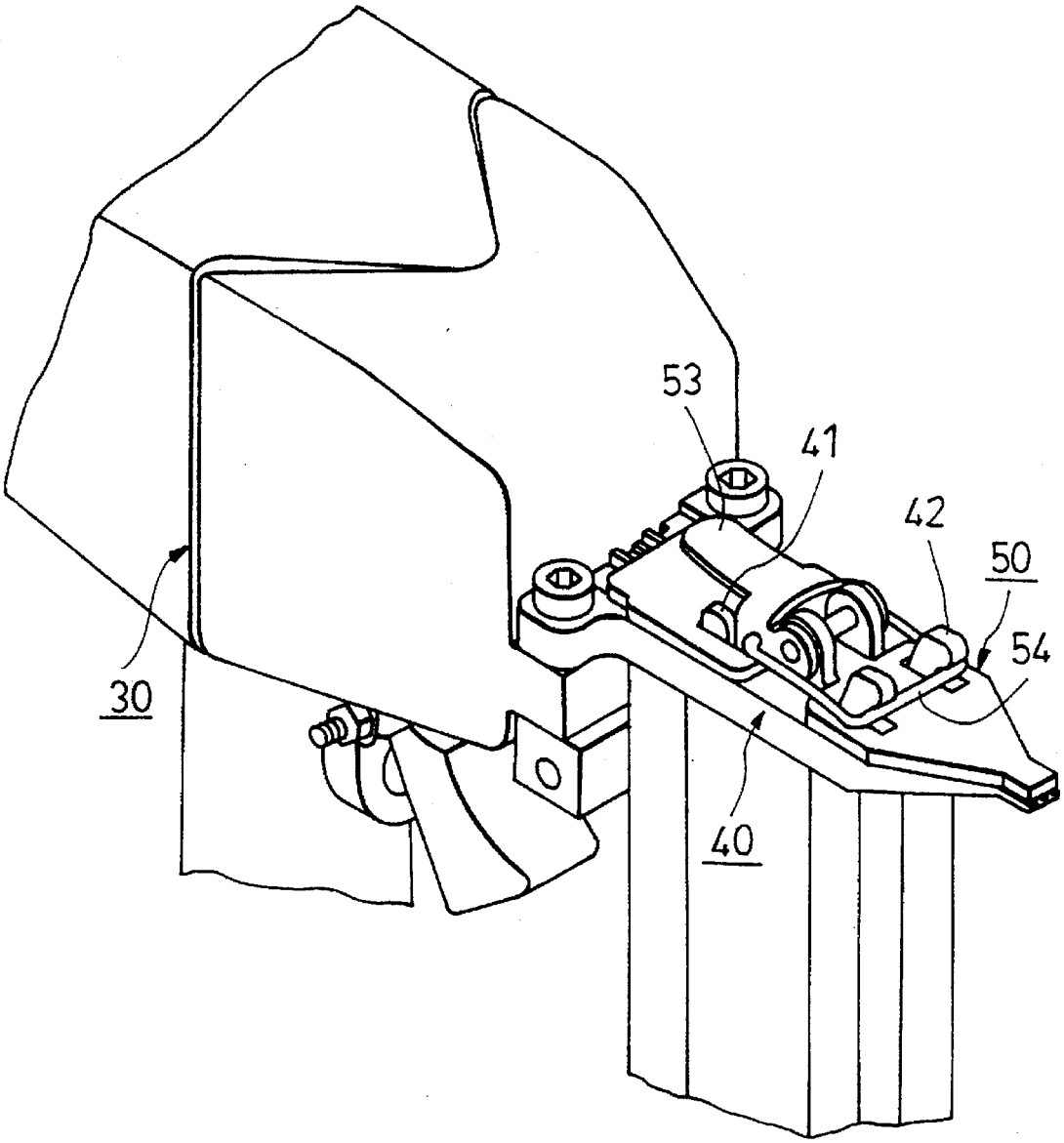
FIG. 6 is a perspective view illustrating the preferred embodiment when a cover plate thereof is secured to a base plate.
Figure 7:
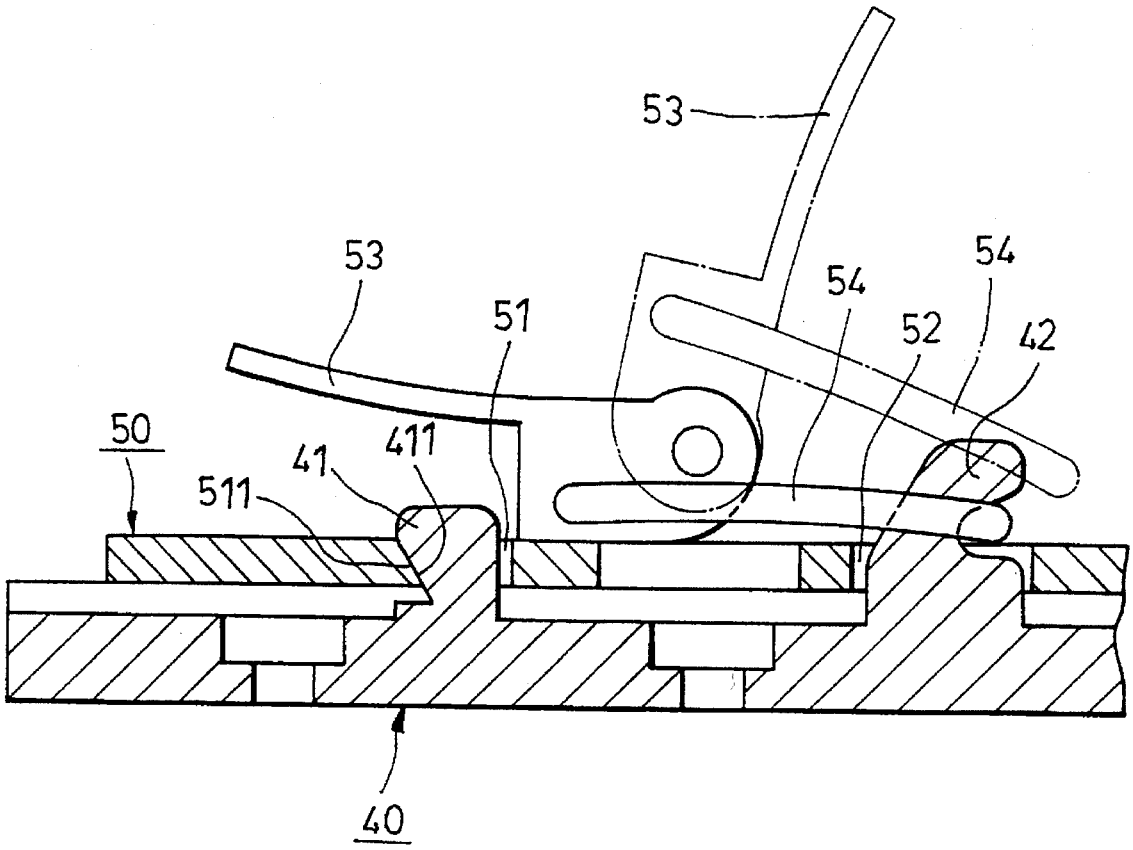
FIG. 7 is a schematic sectional view illustrating how the cover plate of the preferred embodiment is secured to the base plate.

Referring to FIGS. 6 and 7, when installing the cover plate 50 on the base plate 40, the first and second slots 51, 52 on the cover plate 50 are initially aligned with the positioning lugs 41 and the hooking lugs 42 on the base plate 40. The cover plate 50 is then superimposed on the base plate 40. Because the first and second slots 51, 52 are slightly longer than the respective one of the positioning lugs 41 and the hooking lugs 42, the positioning lugs 41 and the hooking lugs 42 can readily pass through the first and second slots 51, 52. The cover plate 50 is then moved forward so that the surfaces 511 of the first slots 51 abut tightly and respectively against the surfaces 411 of the positioning lugs 41. After the fastener 54 has been pivoted relative to the operating lever 53 so as to engage the hooking lugs 42, the operating lever 53 is pivoted rearwardly so as to pull the fastener 54 to engage tightly the hooking lugs 42. The front and rear portions of the cover plate 50 are connected securely to the base plate 40 at this time. Thus, when the nail driving gun 30 is in use, lateral and vertical movement of the cover plate 50 relative to the base plate 40 can be arrested even after the cover plate 50 has experienced shock due to performance of a nail driving operation. Therefore, the risk of untimely removal of the cover plate 50 from the base plate 40 is minimized.

When jamming of the nail driving gun 30 occurs, the cover plate 50 is removed from the base plate 40 to remedy the cause of jamming. To remove the cover plate 50, the operating lever 53 is pivoted forwardly to permit removal of the fastener 54 from the hooking lugs 42 and to permit slight rearward movement of the cover plate 50 relative to the base plate 40. The cover plate 50 may be lifted away from the base plate 40 at this time.

It has thus been shown that the cover plate 50 of the barrel unit of the present invention can be mounted conveniently and removably on the base plate 40 while minimizing the risk of untimely removal from the base plate 40. The object of the invention is thus met.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A barrel unit to be installed on a front end of a nail driving gun, said barrel unit comprising:

an elongated base plate having a top side formed with a longitudinal discharge groove, a pair of upwardly extending positioning lugs which are disposed respectively on opposite sides of said discharge groove and which are located at a rear portion of said base plate, and a pair of upwardly extending hooking lugs which are disposed respectively on opposite sides of said discharge groove and which are located at a front portion of said base plate, each of said positioning lugs having a rearwardly inclining rear end surface; and an elongated cover plate formed with a pair of first slots and a pair of second slots which permit extension of a respective one of said positioning lugs and said hooking lugs therethrough, each of said first slots having a rearwardly inclining end wall surface which abuts against said rear end surface of the respective one of said positioning lugs when said cover plate is superimposed on said base plate, said cover plate further having an operating lever which is mounted pivotally thereon, and a U-shaped fastener which has two ends connected pivotally to said operating lever and which is pivotable so as to engage said hooking lugs on said base plate when said cover plate is superimposed on said base plate, said operating lever being pivotable so as to pull said fastener to engage tightly said hooking lugs.

2. The barrel unit as claimed in claim 1, wherein said first and second slots are slightly longer than the respective one of said positioning lugs and said hooking lugs to facilitate passage of said positioning lugs and said hooking lugs through said first and second slots.

* * * * *